US010932584B2

(12) United States Patent
Brown

(10) Patent No.: US 10,932,584 B2
(45) Date of Patent: Mar. 2, 2021

(54) ADJUSTABLE BED

(71) Applicant: MOTUS MECHANICS LIMITED, Cheltenham (GB)

(72) Inventor: Paul Brown, Chorley (GB)

(73) Assignee: MOTUS MECHANICS LIMITED, Gloucestershire (GB)

( * ) Notice: Subject to any disclaimer, the term of this patent is extended or adjusted under 35 U.S.C. 154(b) by 499 days.

(21) Appl. No.: 15/557,192

(22) PCT Filed: Mar. 11, 2016

(86) PCT No.: PCT/EP2016/055381
§ 371 (c)(1),
(2) Date: Sep. 11, 2017

(87) PCT Pub. No.: WO2016/142547
PCT Pub. Date: Sep. 15, 2016

(65) Prior Publication Data

US 2018/0042392 A1 Feb. 15, 2018

(30) Foreign Application Priority Data

Mar. 11, 2015 (GB) ..... 1504140

(51) Int. Cl.
*A47C 20/12* (2006.01)
*A47C 20/08* (2006.01)
(Continued)

(52) U.S. Cl.
CPC ..... *A47C 20/12* (2013.01); *A47C 19/025* (2013.01); *A47C 20/041* (2013.01); *A47C 20/08* (2013.01)

(58) Field of Classification Search
CPC ..... A47C 20/04; A47C 20/043; A47C 20/046; A47C 20/12; A47C 20/041; A47C 20/08;
(Continued)

(56) References Cited

U.S. PATENT DOCUMENTS 139,493 A * 6/1873 Bray ..... A61G 7/015 5/617
638,466 A 12/1899 Kelly
(Continued)

FOREIGN PATENT DOCUMENTS

CA 851 402 9/1970
CA 851402 9/1970
(Continued)

OTHER PUBLICATIONS

CN 201680014490.8, Office Action, dated May 8, 2019, 8 pages—English, 8 pages—Chinese.
(Continued)

*Primary Examiner* — Robert G Santos
*Assistant Examiner* — Rahib T Zaman
(74) *Attorney, Agent, or Firm* — Andrew F. Young, Esq.; Nolte Lackenbach Siegel

(57) ABSTRACT

The invention concerns an adjustable bed (10) having zero wall clearance and zero gravity functionality. The bed comprises a frame (20) and an adjustable mattress support platform (11) having a plurality of articulated support sections (12, 16, 18) pivotally mounted with respect to one another for relative angular adjustment, and actuator means (52) for effecting coordinated movement of the support sections to reconfigure the bed, between a flat lowered configuration and a raised configuration for supporting an occupant in a zero gravity recumbent position. The actuator means comprises a single actuator, preferably a single linear actuator.

8 Claims, 14 Drawing Sheets

(51) Int. Cl.
*A47C 20/04* (2006.01)
*A47C 19/02* (2006.01)

(58) Field of Classification Search
CPC ..... A47C 19/04; A47C 19/045; A47C 19/025; A61G 7/005; A61G 7/015; A61G 13/02; A61G 13/04; A61G 13/08
See application file for complete search history.

(56) References Cited

U.S. PATENT DOCUMENTS 912,214 A 2/1909 Ward
1,238,078 A 8/1917 Ault
1,414,637 A 5/1922 Gell
2,859,797 A 11/1958 Mitchelson
2,954,072 A 9/1960 Fossati
3,036,862 A * 5/1962 Heinl ..... B60N 2/20 297/367 R
3,086,814 A 4/1963 Fletcher
3,121,589 A 2/1964 Schliephacke
3,202,453 A * 8/1965 Richards ..... B60N 2/3079 296/66
3,369,767 A 2/1968 Greenfield
3,797,050 A * 3/1974 Benoit ..... A61G 7/005 5/610
3,847,430 A 11/1974 Fletcher
3,873,152 A 3/1975 Garas
4,202,062 A 5/1980 Marcyan
4,547,017 A 10/1985 Lescure
4,635,999 A 1/1987 Simpson
4,715,073 A 12/1987 Butler
4,970,737 A 11/1990 Sagel
4,996,731 A * 3/1991 Kruyt ..... A47C 20/041 5/618
5,112,109 A 5/1992 Takada et al.
5,246,266 A 9/1993 Ostergaard
5,625,913 A 5/1997 Singleton
5,640,730 A 6/1997 Godette
5,785,384 A * 7/1998 Sagstuen ..... A47C 1/032 297/317
5,819,345 A 10/1998 Basgall
5,897,462 A 4/1999 St. Germain
6,059,364 A 5/2000 Dryburgh et al.
6,076,209 A 6/2000 Paul
6,101,648 A 8/2000 Sommerfeld et al.
6,163,904 A 12/2000 Royston
6,295,666 B1 * 10/2001 Takaura ..... A61G 7/001 5/611
6,568,755 B1 5/2003 Groening
6,641,214 B2 11/2003 Veneruso
6,739,661 B1 5/2004 Dukes
6,789,280 B1 * 9/2004 Paul ..... A61G 7/012 5/425
7,219,958 B2 5/2007 Yamazaki et al.
7,390,060 B2 6/2008 Kristen
7,445,279 B2 * 11/2008 Crum ..... A47C 1/0355 297/68
7,641,277 B2 * 1/2010 Lawson ..... A47C 1/0355 297/85 L
7,703,851 B2 4/2010 Nakaya et al.
7,997,654 B2 8/2011 Ferry et al.
8,303,036 B2 11/2012 Hankinson et al.
8,403,415 B2 3/2013 Lawson
8,424,964 B2 4/2013 Campbell et al.
8,534,758 B2 9/2013 Rivera
8,955,178 B2 * 2/2015 Robertson ..... A47C 20/041 5/613
9,155,388 B2 10/2015 Robertson
9,808,385 B2 11/2017 Robertson
10,004,334 B2 6/2018 Robertson
10,226,132 B2 * 3/2019 Broom ..... A47C 19/005
2002/0060483 A1 5/2002 Yoshida et al.
2002/0162170 A1 11/2002 Dewert
2002/0174487 A1 * 11/2002 Kramer ..... A61G 7/015 5/618
2003/0172455 A1 9/2003 Roma et al.
2004/0155504 A1 8/2004 Tada
2005/0210588 A1 * 9/2005 Loewenthal ..... A47C 19/04 5/618
2006/0143827 A1 7/2006 Wilming et al.
2006/0225201 A1 * 10/2006 Kristen ..... A47C 1/0352 5/12.1
2007/0120409 A1 5/2007 Leeds
2007/0158980 A1 7/2007 LaPointe et al.
2008/0150329 A1 6/2008 Lawson
2008/0258512 A1 10/2008 Rogers
2009/0044339 A1 * 2/2009 Morin ..... A61G 7/015 5/617
2009/0178201 A1 * 7/2009 Lujan ..... A47C 20/027 5/618
2011/0248530 A1 10/2011 Sartisohn
2014/0103688 A1 4/2014 Wilson
2015/0007391 A1 * 1/2015 Xu ..... A61G 7/018 5/616

FOREIGN PATENT DOCUMENTS

CH 597799 10/1975
CH 587 035 4/1977
CN 202314169 7/2012
CN 203538846 4/2014
CN 203538846 U 4/2014
CN 203576794 U 5/2014
DE 029715343 1/1998
DE 010152227 5/2003
DE 20 2005 015 275 1/2006
DE 10 2007 024 218 11/2008
DE 102007024218 11/2008
DE 10 2007 049 118 2/2009
EP 0865960 3/1998
EP 1 306 032 10/2002
EP 1 537 805 12/2004
EP 1 525 824 4/2005
EP 1 537 805 6/2005
EP 1 621 175 2/2006
EP 1 621 173 B1 3/2011
EP 2 524 623 11/2012
GB 0101239 8/1916
GB 0329834 5/1930
GB 0414464 8/1934
GB 632121 11/1949
GB 0775679 5/1957
GB 1 317 804 5/1973
GB 1317804 5/1973
GB 2 085 719 8/1980
GB 2227932 8/1990
GB 2418846 12/2006
GB 2472920 2/2011
GB 2486335 6/2012
GB 2472920 2/2014
GB 191322022 8/2014
GB 2520430 11/2015
GE 20 2007 009 068 12/2007
JP 36-13946 5/1936
JP 558 58016 1/1983
JP 08-173263 7/1996
JP 08-308680 11/1996
JP 11-244096 9/1999
JP 2003-144262 5/2003
LI 0781518 12/1996
SE C2 510 584 6/1999
WO WO 96/29970 10/1996
WO WO 02/076367 10/2002
WO WO 02/085164 10/2002
WO WO 02/085164 A1 10/2002
WO WO 2005/051128 6/2005
WO WO 2005/107533 11/2005
WO WO 2006/023447 3/2006
WO WO 2007/124067 11/2007
WO WO 2008/129565 10/2008
WO WO 2008/132481 11/2008
WO WO 2011/021002 2/2011
WO WO/2011/021002 2/2011

(56) References Cited

FOREIGN PATENT DOCUMENTS

| | | |
|---|---|---|
| WO | WO2011/048384 | 4/2011 |
| WO | WO 2011/048384 | 4/2011 |
| WO | WO 2011/048384 A1 | 4/2011 |
| WO | WO 2012/032305 | 3/2012 |
| WO | WO 2012/099061 | 7/2012 |
| WO | WO 2013/061259 | 5/2013 |
| WO | WO 2014/183112 | 11/2014 |
| WO | WO 201/5011432 | 9/2015 |
| WO | WO2016/058949 | 4/2016 |

OTHER PUBLICATIONS

CN 201680014490.8, Second Office Action dated Dec. 26, 2019, 7 pages—Chinese, 10 pages—English.
GB 1316684.8, International Search Report and Written Opinion, 7 pages—English.
PCT/GB2015/000315, International Search Report and Written Opinion, dated Jul. 3, 2016, 9 pages—English.
GB1422032.1, Search Report dated Apr. 29, 2015, 2 pages—English.
GB1319926.0 Search Report dated May 1, 2014, 4 pages—English.
GB1419811.3 Search Report dated Dec. 17, 2014, 7 pages—English.
PCT/GB2014/000452 Search Report and Written Opinion, 9 pages—English.
PCT/GB2015/000314, Search Report and Written Opinion, dated Jul. 3, 2016, 9 pages.
PCT/EP2015/080892, Search Report and Written Opinion, dated Mar. 24, 2016, 9 pages.
Pat. No. GB 1417108.6, Combined Search and Examination Report dated Mar. 26, 2015, 7 pages—English.
EasyCliner® wood-to-the-floor recliner mechanism, 1 page, HomeFurnitureComponents.com, Apr. 10, 2015.
GB1313002.6, Search Report dated Jan. 21, 2014, 4 pages.
PCT/GB2014/000274, Written Opinion dated Jan. 21, 2014, 5 pages.
U.S. Appl. No. 13/390,985, filed Feb. 17, 2012, Office Action dated Jan. 7, 2015, 20 pages.
PCT/GB2010/001565 International Search Report dated Apr. 12, 2011, 6 pages—English.
PCT/EP2016/055381, International Search Report and Written Opinion, dated May 30, 2016, 11 pages—English.
GB 1316684.8, International International Search Report and Written Opinion, 7 pages—English.
EP Appln. No. 08 737 140.7, European Search Report dated Jan. 6, 2018, 4 pages—Englsih.
PCT/GB2017/051732, International Preliminary Report on Patentability and Written Opinion, dated Dec. 18, 2018, 8 pages—English.
Pat. No. GB 1713668.0, Examination Report dated Sep. 16, 2020, 3 pages—English.
CN 201680014490.8, Decision on Rejection, dated May 19, 2020, 4 pages—English, 5 pages—Chinese.
EP16709470.5, Examination Report dated Nov. 2, 2020, 5 pages—English.
Appln. Patent No. GB1713668.0, Office Action dated Nov. 24, 2020, 2 pages—English.

* cited by examiner

ADJUSTABLE BED

CROSS REFERENCE TO RELATED APPLICATIONS

This application relates to and claims priority as a § 371 national phase, from PCT/EP2016/055381 filed Mar. 11, 2016, the entire contents of which are incorporated herein by reference, which in turn claims priority from Great Britain Ser. No. 1504140.3 filed Mar. 11, 2015.

FIGURE SELECTED FOR PUBLICATION

FIG. 2

BACKGROUND OF THE INVENTION

Field of the Invention

This invention relates to adjustable beds having adjustable mattress support sections which can be moved to adjust the configuration of the bed.

Description of the Related Art

Adjustable beds are known, for example, from US2002/0174487 which discloses a hospital bed having adjustable back and thigh sections. The hospital bed of US2002/0174487 comprises a frame having a pair of parallel and spaced apart first and second side frame members; a mattress support deck including an adjustable back section having first and second sides; a fixed seat section located adjacent to the back section and an adjustable thigh section located adjacent to the seat section and movable relative to the seat section, to increase the length of the thigh section, as the thigh section is raised relative to the frame. First and second curved tubes are coupled to respective first and second sides of the back section. A plurality of rollers are coupled to the first and second side frame members, with the rollers being configured to support the first and second curved tubes to permit movement of the curved tubes and the back section relative to the frame. A linear actuator is disposed beneath the back section and coupled to the first and second tubes to move the back section from a horizontal position to an elevated position relative to the frame. Two concentric arcuate tubes are provided on each side of the bed which have a radius of curvature centered on a location which emulates the natural hip pivot of a person lying on the mattress of the bed. The tubes are secured between three rollers on each side of the bed. Two rollers are located on a bottom side of the radially outer tube, that is to say radially outwards thereof, and the third roller is located on a top side of the radially inner tube. A pair of cross-members extend between the tubes. The arrangement provides a so called shear-less pivot mechanism in which the adjustable back section pivots about the natural hip point of the person on the bed.

The arrangement disclosed in US2002/0174487 may be considered heavy, robust and mechanically complex. This structure, while suitable for hospital beds, does not readily provide an arrangement that is suitable for more lightly used applications such as domestic furniture, where other design considerations, such as weight and cost and mechanical simplicity, come into play.

An adjustable bed particularly suitable for domestic furniture applications is described in WO2011/048384. This bed comprises a mattress support deck having a plurality of mattress support sections, including a movable back support section, a fixed seat section adjacent to the back support section, a movable thigh support section adjacent the seat section and a movable foot or lower leg support section adjacent and hinged to the thigh support section. The back and thigh support sections are mounted with respect to the base to allow angular adjustment of their relative positions to alter the configuration of the bed. Linear actuators are provided for moving each of the movable sections to effect angular adjustment of the bed. A pair of load-bearing arcuate members are spaced apart on opposite lateral sides of both the back and thigh sections. The load bearing members project from the underside of the respective support sections and are each provided with bearings arranged to run on a respective curved support provided in or on a respective side panel of the base. The load bearing members are rigidly connected together by a suitable cross-member on the underside of the respective support sections. Each cross member provides a suitable attachment point for one end of a linear actuator. The arrangement provides a robust box-section type construction, the four sides of which are provided by the support section, typically a panel of board material, the two load bearing members on opposite sides of the support section and the cross-member. This construction provides for rigidity that resists twisting of the structure and hence maintains alignment of the bearings and respective curved support guides in the side panels of the base.

There is a requirement for an adjustable bed which is mechanically less complicated than hitherto known designs and which has attendant weight and cost advantages.

ASPECTS AND SUMMARY OF THE INVENTION

According to an aspect of the present invention there is provided an adjustable bed having zero wall clearance and zero gravity functionality; said bed comprising a frame and an adjustable mattress support platform having a plurality of articulated support sections pivotally mounted with respect to one another for relative angular adjustment, and actuator means for effecting coordinated movement of said support sections to reconfigure the bed between a flat lowered configuration and a raised configuration for supporting an occupant in a zero gravity recumbent position.

The movement of panel 12 follows a zero wall clearance path throughout its range of movement, that is to say a constant gap is maintained between the rearward edge of the panel 12 and surrounding structure, for example a headboard of the bed or adjacent wall, when the panel 12 moves rearwards or forwards with respect to the frame during adjustment of the bed.

This aspect of the present invention provides a wall proximity adjustable bed in which the position of the occupant is maintained in proximity with a wall against which the head end of the bed may be arranged. This desirable functionality ensures that the occupant's position is maintained with respect to adjacent bedside furniture and the like when the bed is raised or lowered, maintaining the position of the occupant with respect to their surroundings even when the bed is adjusted to raise the occupant towards a recumbent position. The above aspect of the present invention combines wall proximity or "zero wall" functionality with so called "zero-gravity" functionality, that is to say an adjustable bed that is capable of supporting the occupant in a zero gravity recumbent position when the backrest is raised to an inclined position.

The actuator means preferably comprises a single actuator, more preferably a single linear actuator. Thus, the present invention envisages embodiments where adjustment is effected by a single actuator, with attendant cost advantages.

In preferred embodiments the plurality of articulated mattress support sections include at least a head end section, a toe end section and an intermediate section disposed between the head and toe end sections. Preferably the adjustable bed includes three sections the head end section, the toe end section and intermediate section. In other embodiments the toe end section may be further divided to provide a so called foot adjustment section in addition to a lower leg support section, with a hinge joint therebetween.

Preferably the adjustable bed further comprises cam means associated with one of the frame and the intermediate support section, and cam follower means associated with the other of the frame and the intermediate movable support section.

The cam means is preferably arranged so that movement of the intermediate support section follows a rearward and downwards trajectory with respect to the frame as the head end section is raised. The intermediate support section preferably rotates as it moves rearwards, that is to say it tilts with its rear end adjacent the head end section lowered relative to its forward end relative to the toe end section.

In preferred embodiments the head end section is simply supported at a position along its length, preferably by a fulcrum, such that said rearward and downward movement of the intermediate support section causes the head end section to rotate about its pivot axis to an inclined position with respect to the frame.

The fulcrum preferably comprises roller means fixed in relation to the frame, for example a bearing or the like. In other embodiments the roller means may be provided on the head end section and said roller means engage cam means, preferably a ramp, on the frame.

The frame preferably comprises first and second spaced apart parallel side frame members, preferably the side frame members are shaped as an inflexion curve. In other embodiments the side frame members may be straight and extend horizontal along the length of the bed.

The cam means and cam follower means may be provided on both lateral sides of the bed.

The cam follower means may comprise a roller, bearing or the like.

Preferably, the cam means and cam follower means are provided at both lateral sides of the frame such that the intermediate support section is supported on both sides of the bed.

In preferred embodiments the cam means comprises first and second guides.

The first and/or second guides may comprise first and second guide sections.

The first and/or second guide sections preferably comprise at least one curved guide section.

In preferred embodiments the first guide section comprises a curved guide section. In other embodiments the first guide means comprise a linear guide.

The first guide may comprise a curved first section contiguous with a linear second guide section.

Preferably, the first curved guide section has a cam profile that is configured so that initial movement of said intermediate section by said actuator in a rearwards direction has a greater downward vertical component of movement than in said second guide section.

The above aspect of the invention provides a simple arrangement for adjustable beds of the aforementioned zero gravity type. Mutual engagement of the cam means and cam follower means is readily maintained in all adjustment configurations. This can reduce weight and cost in arrangements of adjustable furniture as less complex structures may be implemented. In particular the above aspect of the invention contemplates embodiments without complex and expensive multiple actuating elements. This aspect of the invention can achieve significant weight and cost advantages without compromising performance and durability. This is a particular consideration in the domestic furniture industry where manufacturing cost is often of critical importance to product success in the marketplace. A significant advantage of the above aspect of the present invention is that the profile of the bed, that is to say the depth dimension of the bed, can be minimized, and thereby a low profile adjustable bed can be realized with attendant storage and shipping cost advantages, particularly when compared with hitherto known designs, due to a smaller depth dimension of the part assembled bed and actuation system. In this respect it will be understood that the depth dimension for shipping purposes is the depth of the bed minus legs or other support means which are shipped unassembled. Thus the reduced depth dimension readily enables greater number of units to be shipped in a given space, such as an ISO container or the like.

Preferably, the cam means is associated with the frame and the cam follower means is associated with the movable support section. The present invention also contemplates embodiments with the opposite arrangement, that is to say where the cam means is associated with the movable support section and the cam follower means is associated with the frame. However, the former arrangement, as in the illustrated embodiments disclosed herein, has been found to provide for a compact and mechanically efficient actuation system for adjustable furniture, particularly adjustable beds.

The cam follower means is preferably fixed in relation to a moving part of the actuator means. In this way movement of the cam follower means is directly related to movement of the actuator.

The actuator means preferably comprises a linear actuator arranged to move the cam follower means in the general longitudinal direction of the frame. The present invention therefore contemplates embodiments where commercially available linear actuators may be utilized.

Preferably, the cam follower is fixed in relation to a cam follower support element fixed in relation to the movable intermediate support section. The cam follower support element preferably comprises a planar element or bracket disposed on the underside of a panel of the intermediate movable support section. This provides for a compact mechanical arrangement on the underside of the panel where the element/bracket can be positioned closely adjacent to the frame.

The above aspect of the invention contemplates an adjustable bed in which the adjustable support sections collectively provide all or part of a mattress support deck The present invention contemplates embodiments in which the bed has an adjustable backrest/headrest support section which may be raised or lowered, between a lowered horizontal position and a raised inclined position as is well known in the art.

In preferred embodiments, the floor standing frame comprises first and second spaced apart parallel side frame members. This provides for a robust construction and which is preferably in the form of a rectangular structural frame.

In preferred embodiments actuator means is arranged to apply the adjustment force substantially to the underside of the support section to which it is attached, for example the intermediate support section of the head end support section. In this way the actuator loads may be minimized by increasing the perpendicular distance between the pivot axis of the respective support sections and the point of application of actuator load.

In preferred embodiments the actuator is disposed substantially horizontally with the frame on the underside of the respective adjustable support sections, and more preferably the actuator remains substantially horizontal throughout its operable range of movement.

In preferred embodiments, cam means and cam follower means are provided on both lateral sides of the frame such that the movable intermediate support section is supported on both sides thereof. Thus, the above aspect of the invention readily enables the weight of the bed, including the weight of the occupant(s) and actuation system, to be evenly distributed and supported by the load bearing structure of the bed, which structure may be integrated in such a way that the weight carried by the furniture is evenly supported by the frame. The arrangement of the cam and cam follower means readily enables the adjustable support sections to be moved in a coordinated manner about their respective pivot axis.

The above and other aspects, features and advantages of the present invention will become apparent from the following description read in conjunction with the accompanying drawings, in which like reference numerals designate the same elements.

BRIEF DESCRIPTION OF THE DRAWINGS

Embodiments of the present invention will now be more particularly described, by way of example only, with reference to the accompanying drawings; in which.

DETAILED DESCRIPTION OF THE PREFERRED EMBODIMENTS

Figure 1:
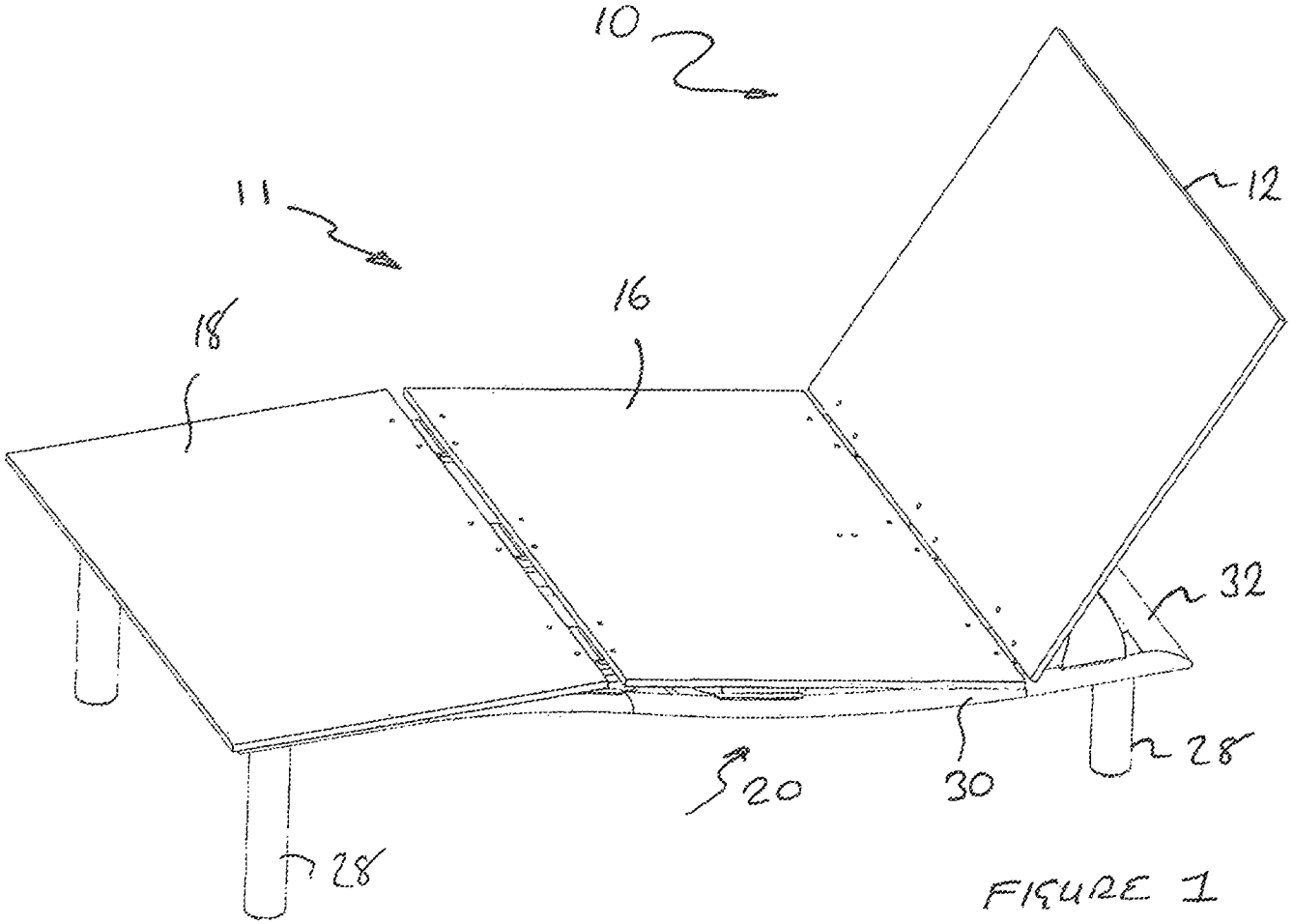
FIG. 1 is a perspective view from above of a an adjustable bed according to an embodiment of the present invention, with the bed in an upright configuration for supporting an occupant in a recumbent zero gravity position.
Figure 2:
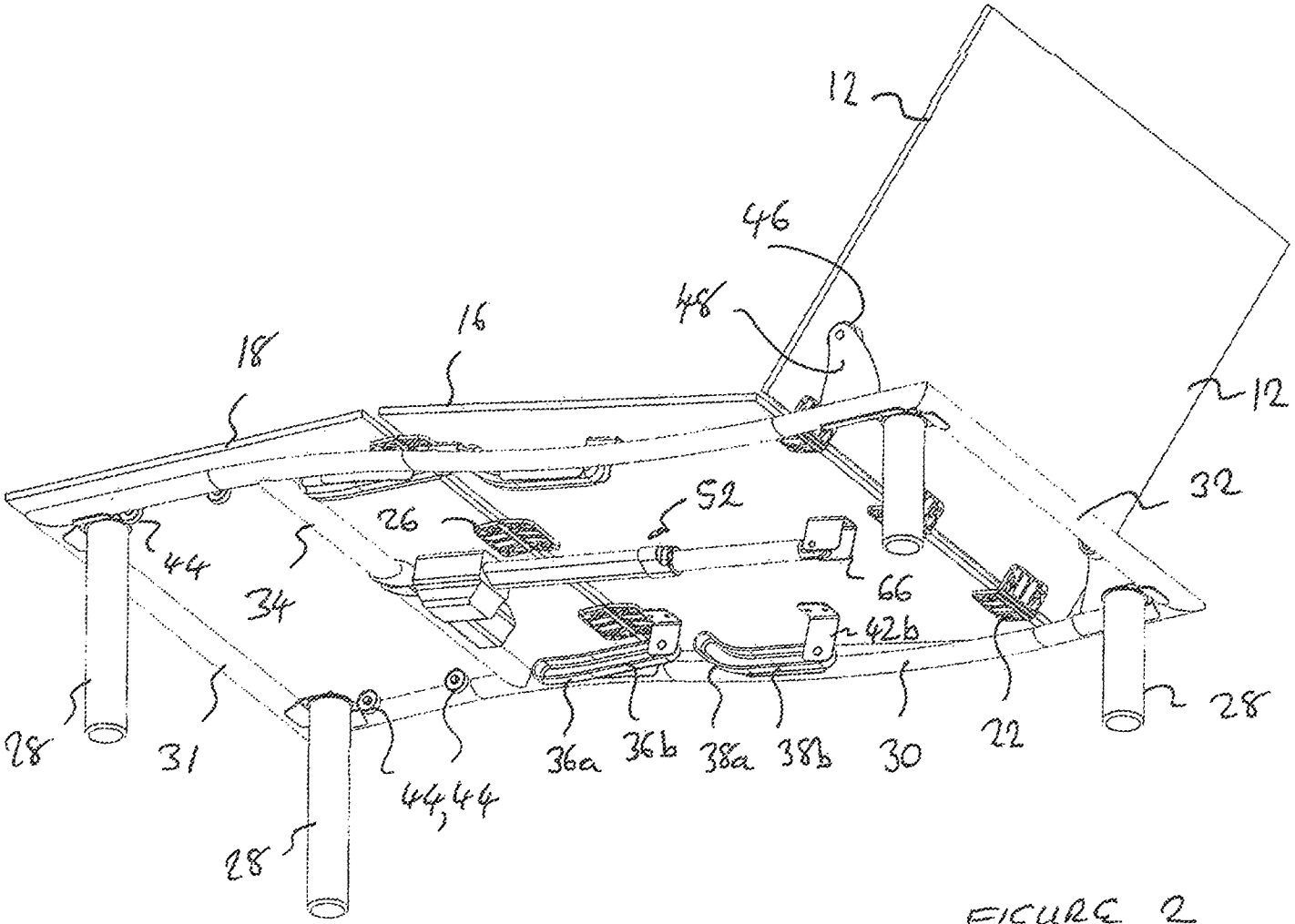
FIG. 2 is a perspective view of the bed of FIG. 1 with the bed viewed from below.
Figure 3:
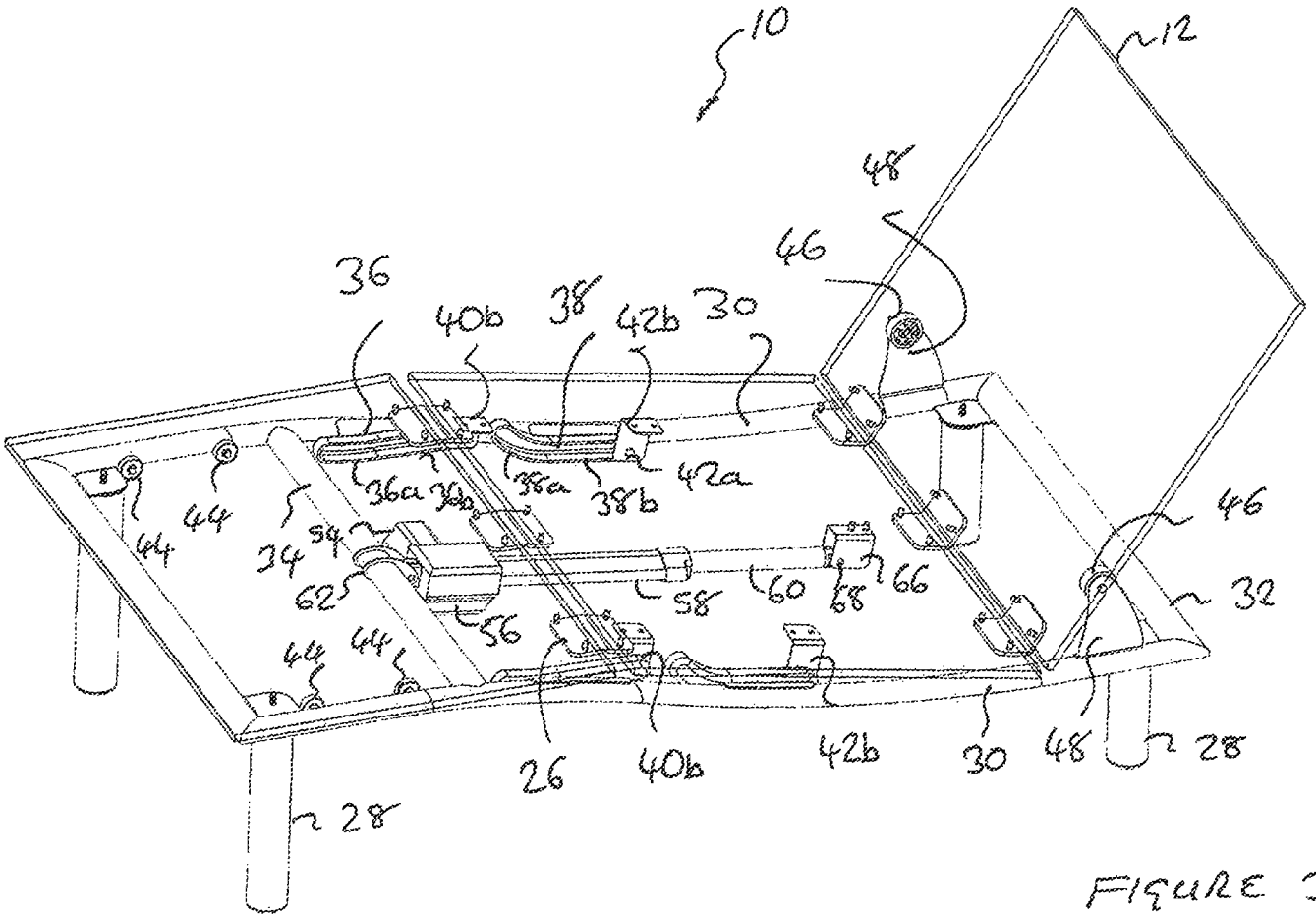
FIG. 3 is a perspective view similar to FIG. 1 with the mattress support deck of the bed shown in ghost outline.
Figure 4:
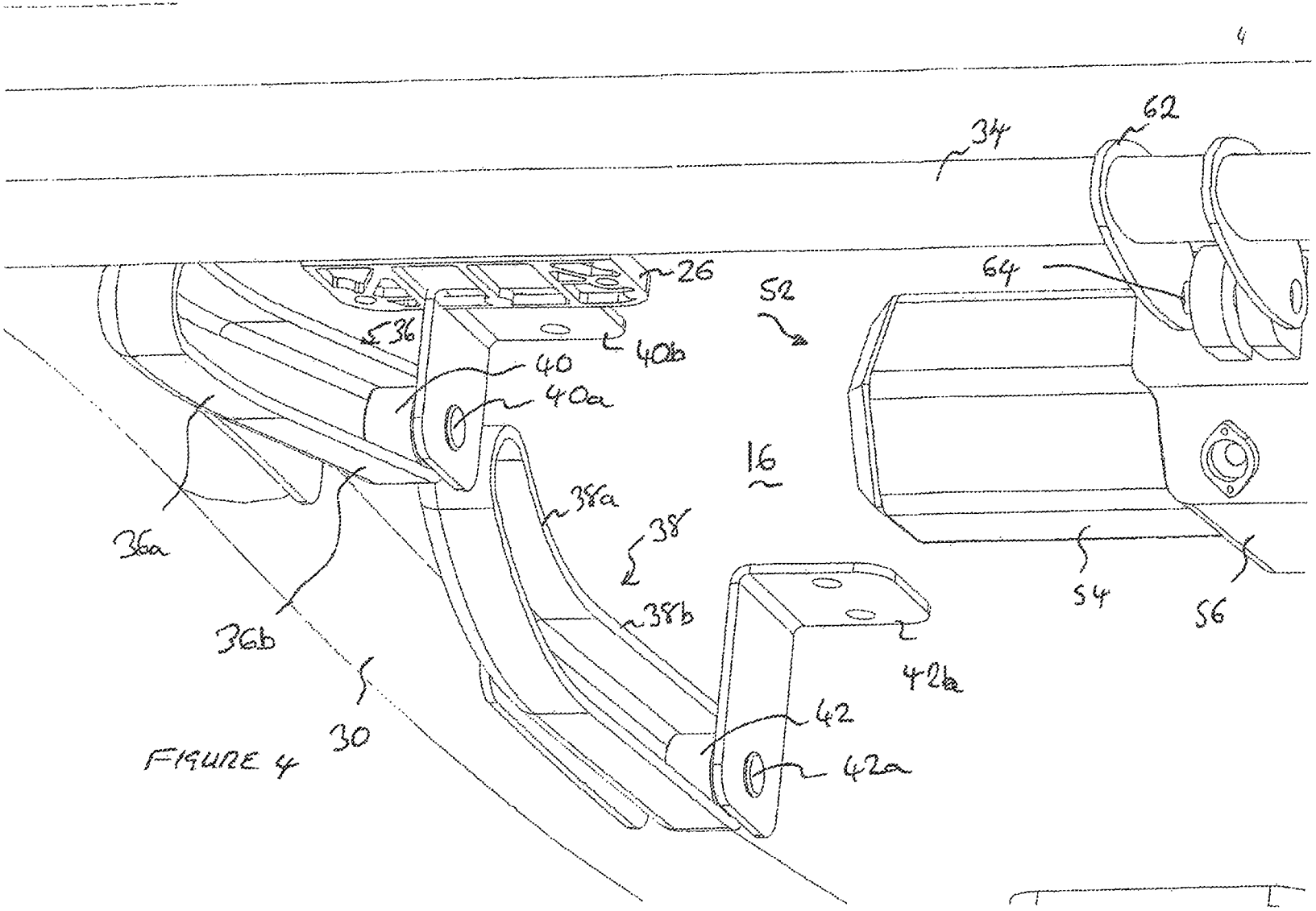
FIG. 4 is an enlarged perspective view of the underside of the mid-section of the bed shown in FIG. 1.
Figure 5:
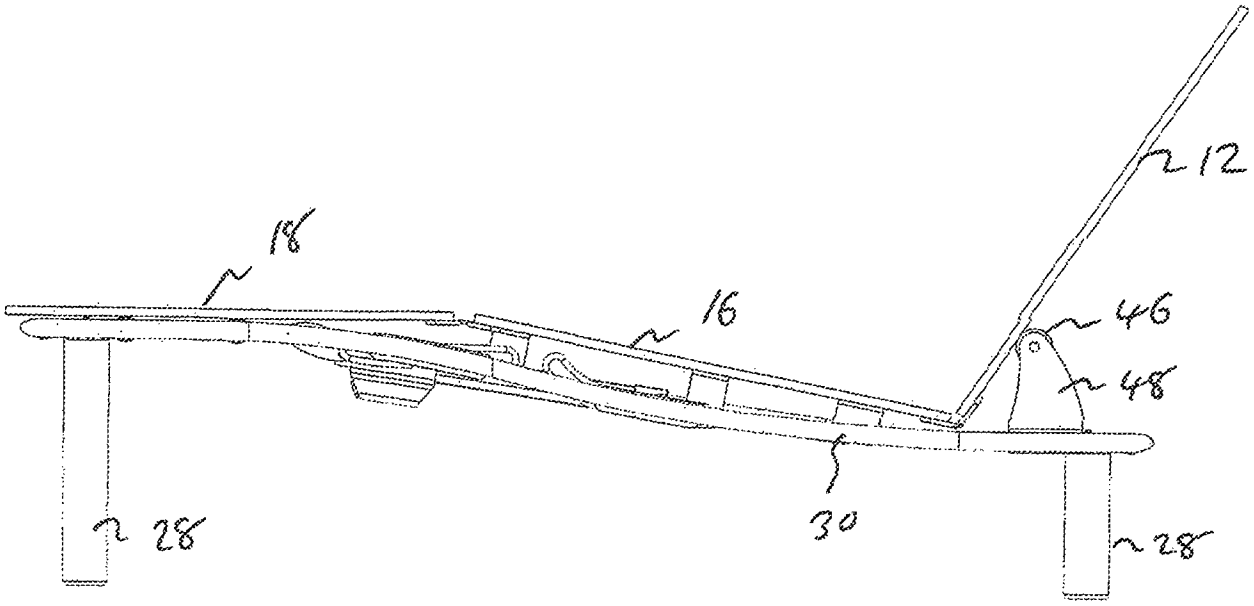
FIG. 5 a side elevation view of the bed of FIG. 1, with the bed in the upright configuration of FIG. 1.
Figure 6:
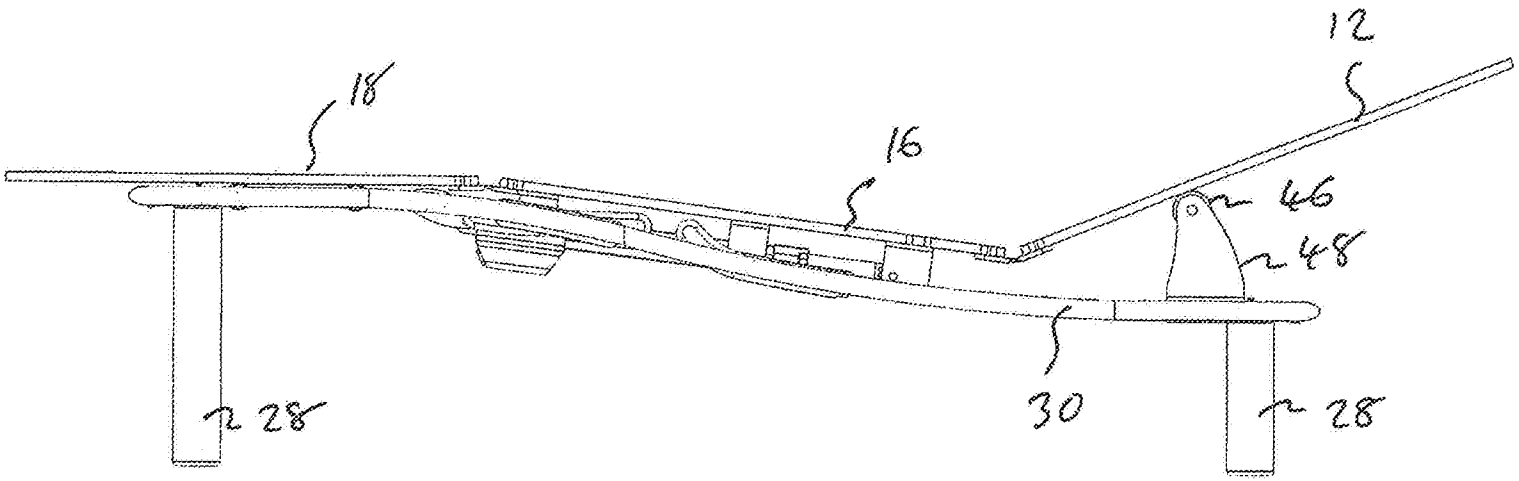
FIG. 6 a side elevation view of the bed of FIG. 1, with the bed in an intermediate semi-recumbent position.

Reference will now be made in detail to embodiments of the invention. Wherever possible, same or similar reference numerals are used in the drawings and the description to refer to the same or like parts or steps. The drawings are in simplified form and are not to precise scale. The word 'couple' and similar terms do not necessarily denote direct and immediate connections, but also include connections through intermediate elements or devices. For purposes of convenience and clarity only, directional (up/down, etc.) or motional (forward/back, etc.) terms may be used with respect to the drawings. These and similar directional terms should not be construed to limit the scope in any manner. It will also be understood that other embodiments may be utilized without departing from the scope of the present invention, and that the detailed description is not to be taken in a limiting sense, and that elements may be differently positioned, or otherwise noted as in the appended claims without requirements of the written description being required thereto.

Various operations may be described as multiple discrete operations in turn, in a manner that may be helpful in understanding embodiments of the present invention; however, the order of description should not be construed to imply that these operations are order dependent.

As will be understood by those of skill in the art, the phrase 'zero gravity' is used descriptive as representing the functional and structural results herewith and not an actual expression that there is no gravity.

Referring to the drawings, FIGS. 1 to 9 schematically show an adjustable bed 10 according to an embodiment of the present invention. The bed 10 comprises a mattress support deck 11 composed of three adjacent mattress support section panels, including an adjustable back/head (upper body) support section panel 12 at the head end of the bed, an intermediate support section panel 16 in the middle of the bed and a foot and lower leg support section panel 18 at the toe end of the bed. The panels 12, 16 and 18 are adjustably mounted on a structural support frame 20. In the drawings of FIGS. 2 to 10 the panels 12, 16 and 18 are shown in ghost outline to reveal the detail construction of the adjustable bed including the support frame and the actuating mechanism of the bed. The panels 12, 16 and 18 are substantially the same size and in the illustrated embodiment have a width dimension slightly greater than the width of the frame.

Figure 7:
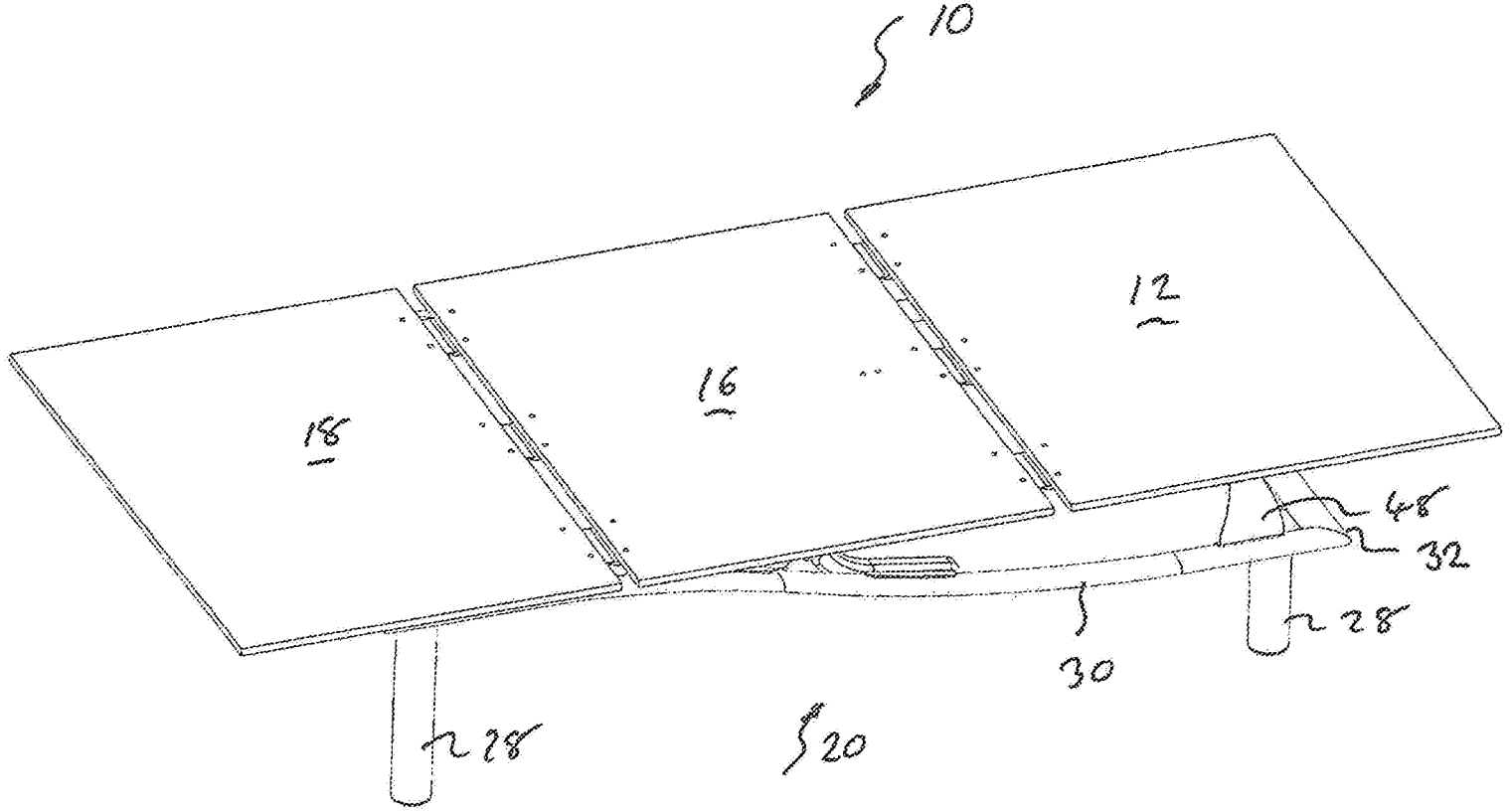
FIG. 7 is a perspective view of the bed of FIG. 1 with the bed viewed from the left hand side front quarter, with the bed shown in the fully lowered position.
Figure 8:
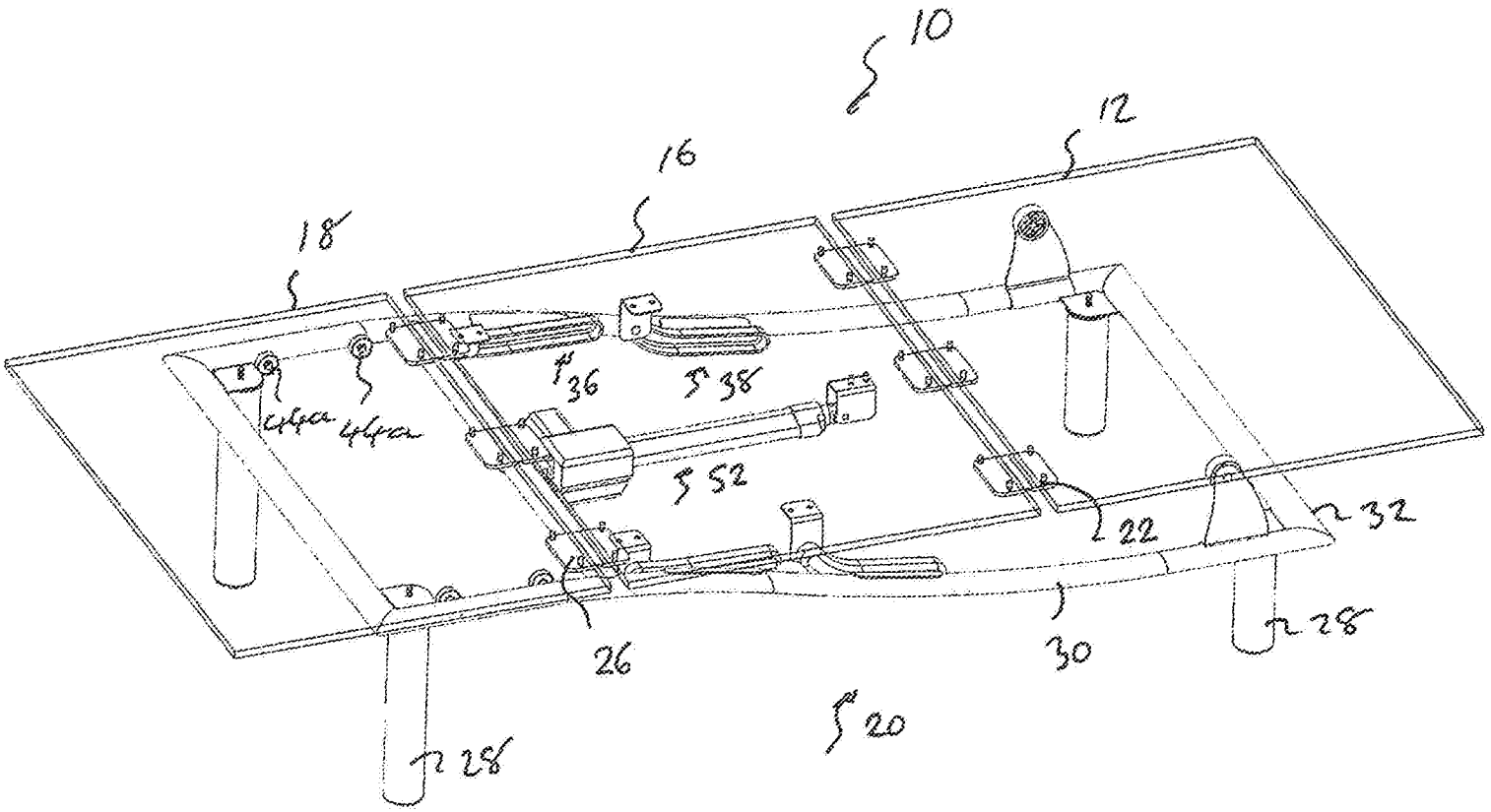
FIG. 8 is a perspective view similar to FIG. 7 with the mattress support deck of the bed shown in ghost outline.
Figure 9:
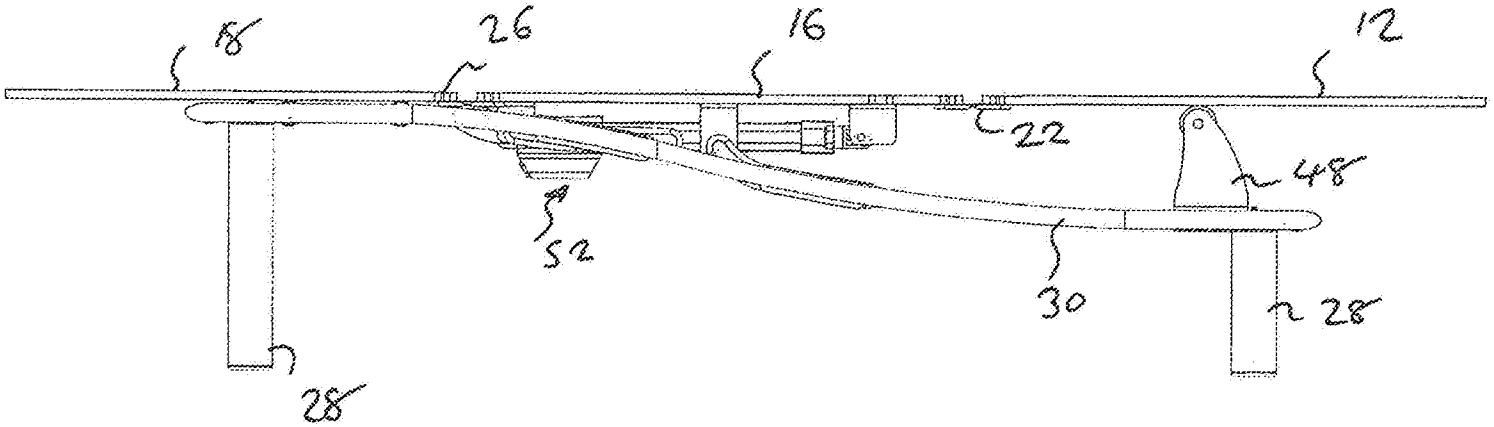
FIG. 9 a side elevation view of the bed of FIG. 1, with the bed in the fully lowered position of FIG. 7.
Figure 10:
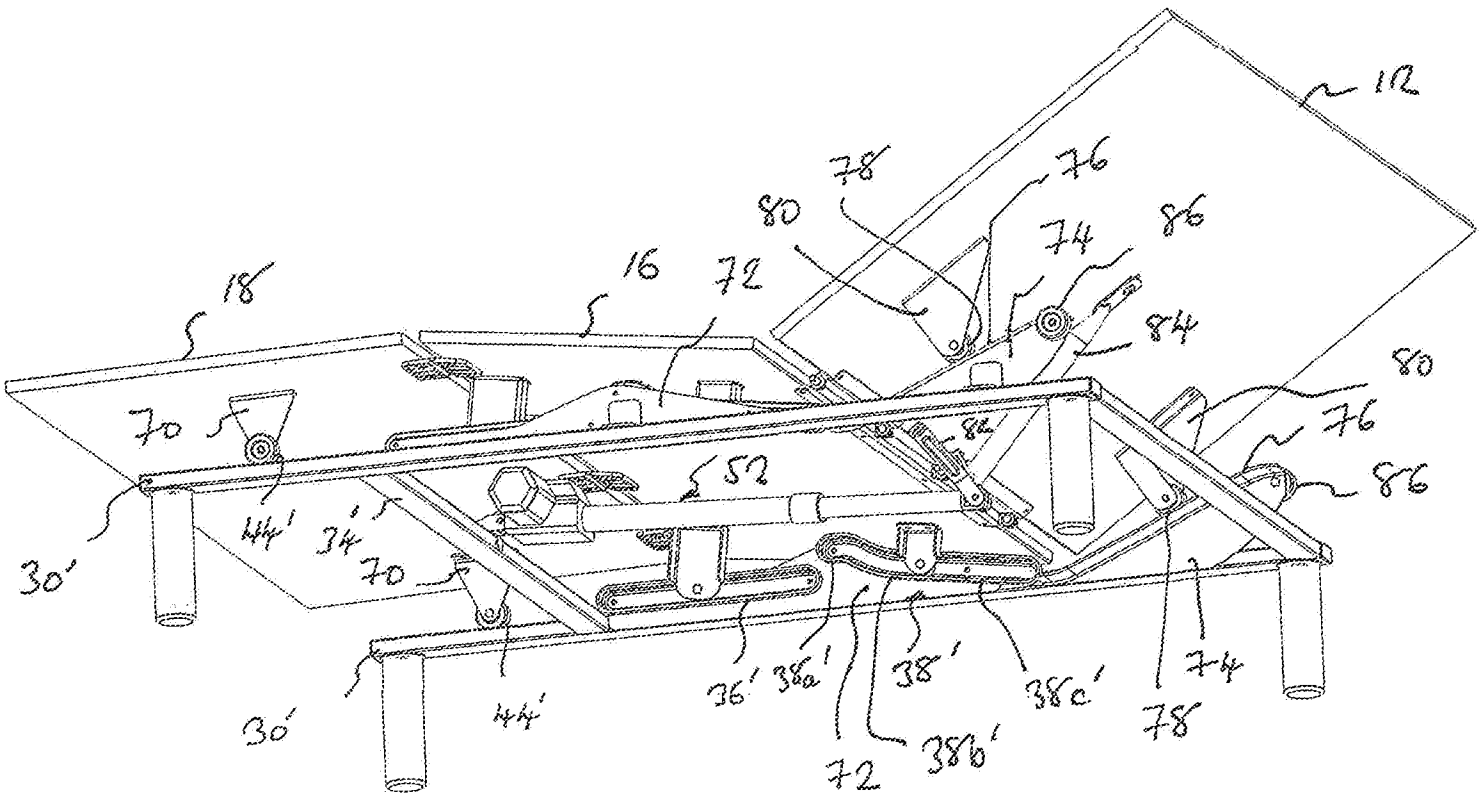
FIG. 10 is a perspective view from below of a an adjustable bed according to another embodiment of the present invention, with the bed in a semi-upright configuration for supporting an occupant in a recumbent zero gravity position.
Figure 11:
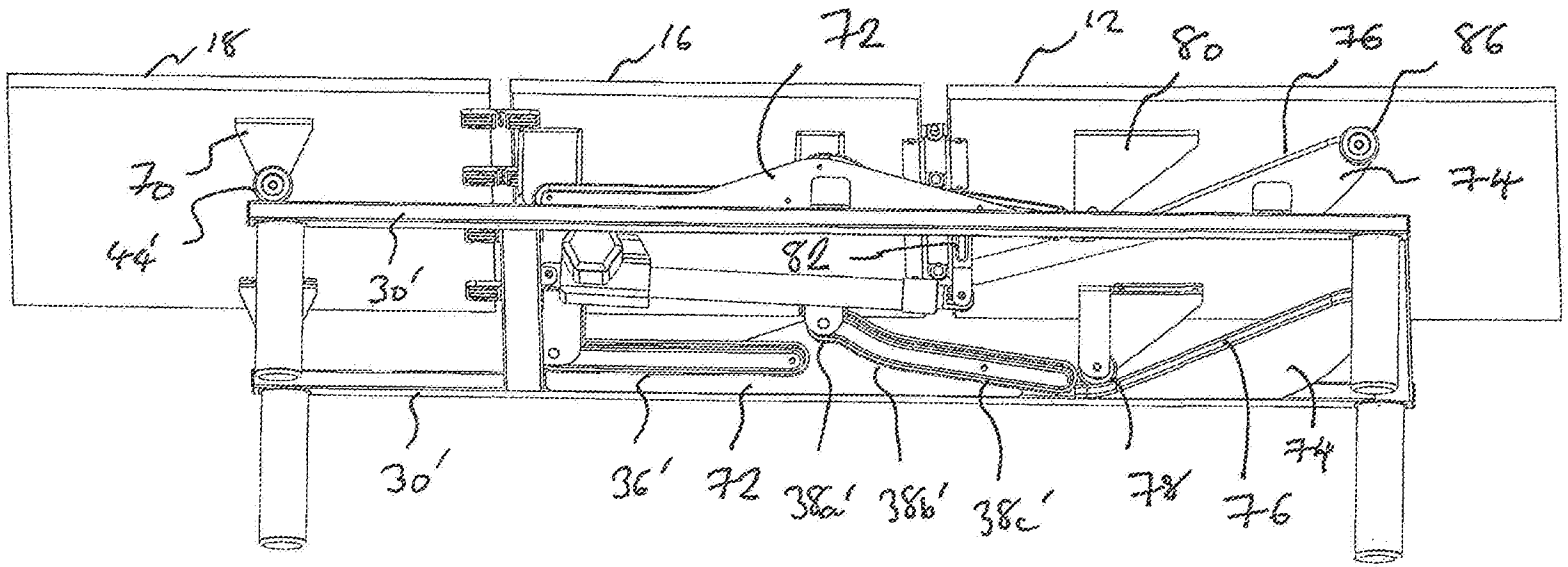
FIG. 11 is a perspective view from below of the adjustable bed of FIG. 10, with the bed in a fully lowered configuration.
Figure 12:
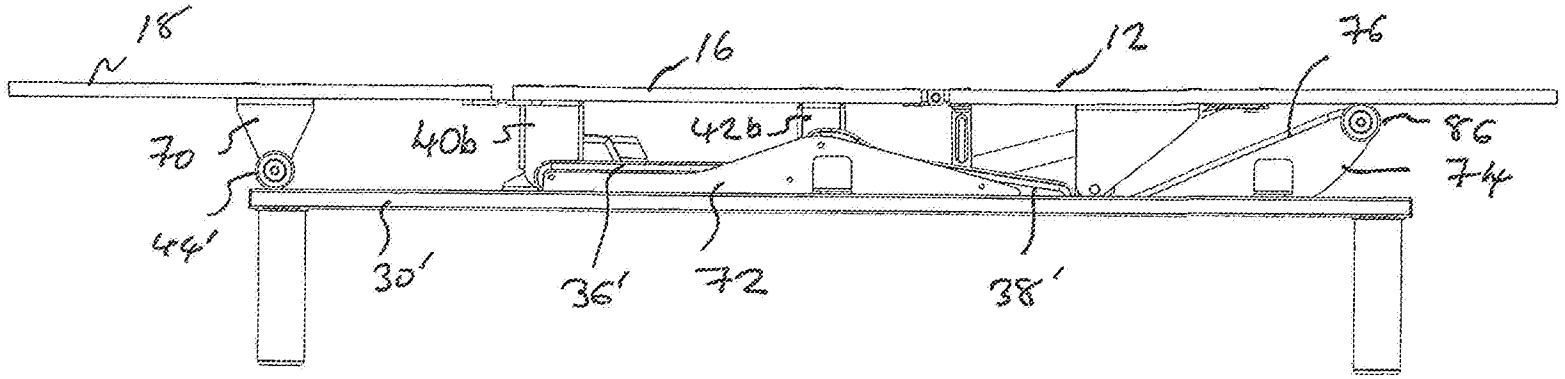
FIGS. 12 to 14 are respective side views of the bed of FIG. 10 with the bed shown in lowered, intermediate and raised positions.
Figure 13:
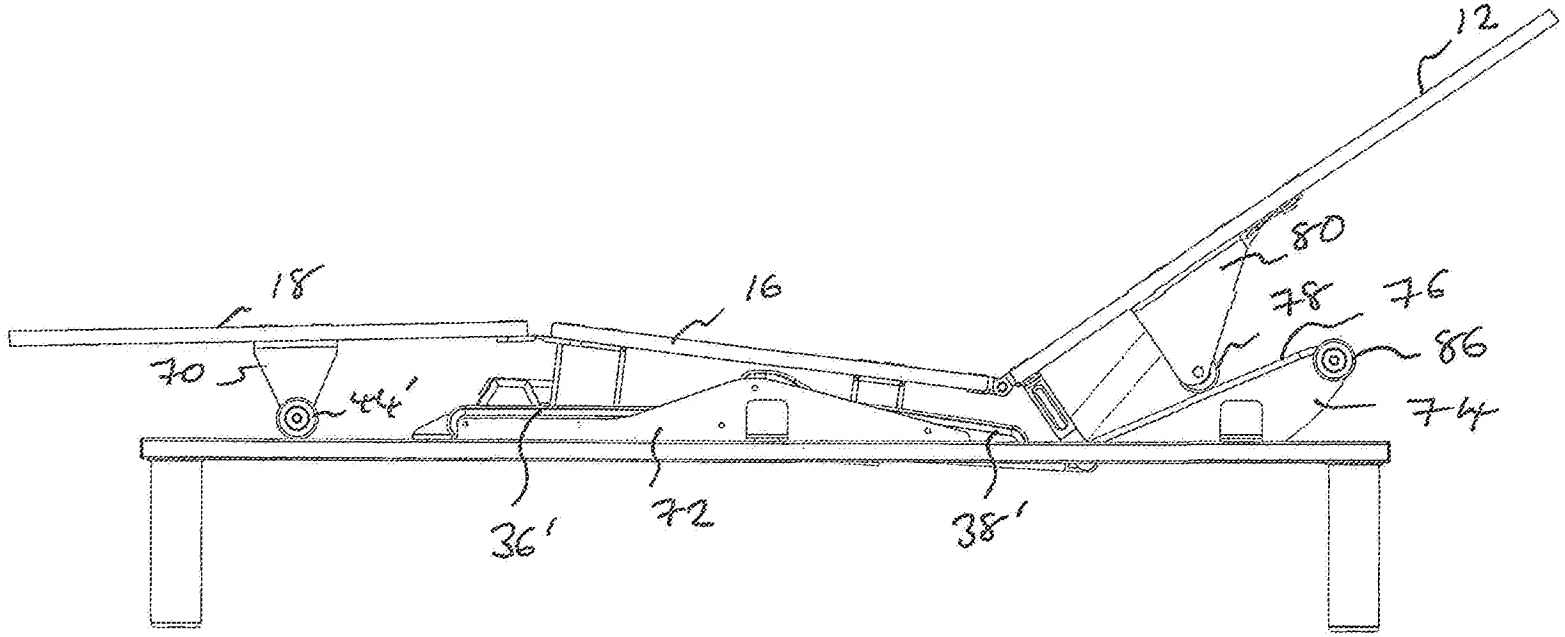
Figure 14:
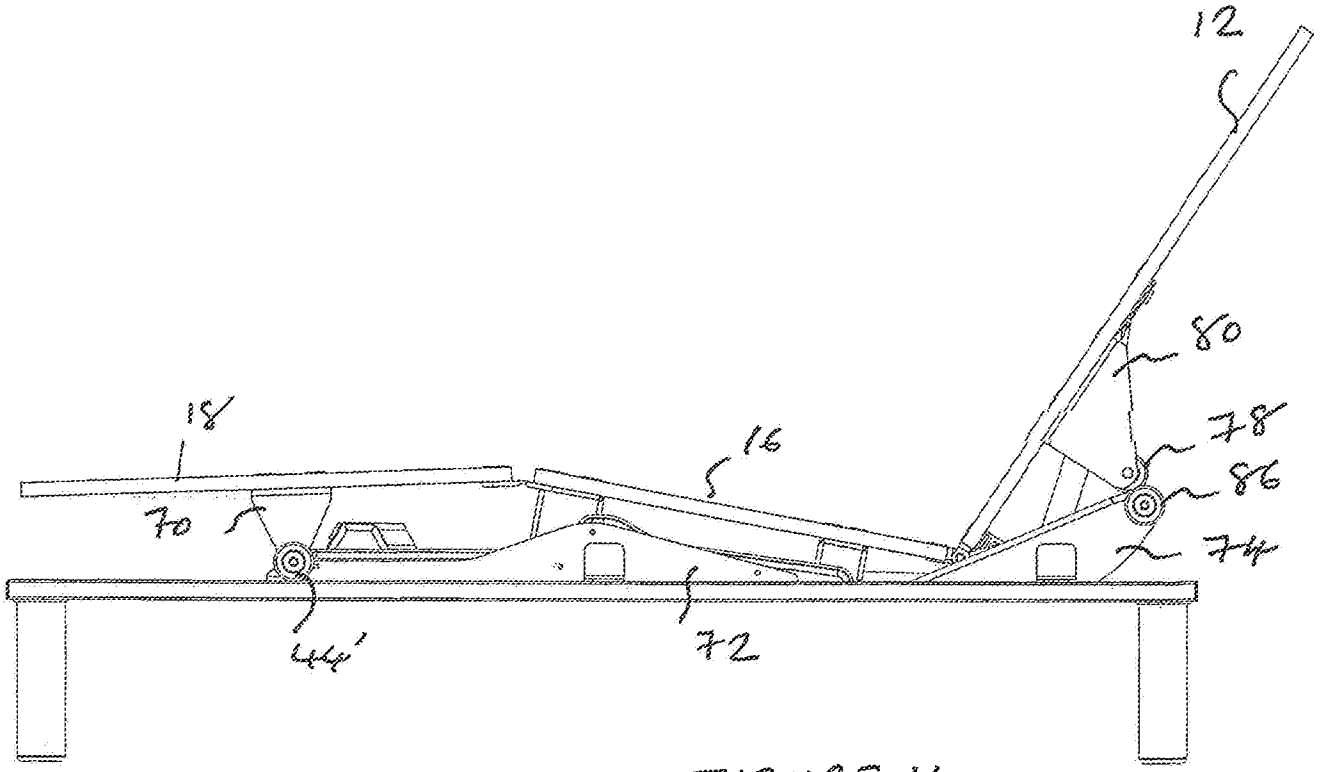

In the un-articulated configuration of FIGS. 7 to 9, the panels 12, 16 and 18 are aligned in a flat horizontal planar relationship. The panels 12, 16 and 18 are preferably constructed of wood, MDF or other suitable board material.

The panels may include upholstered cushions or pads (not shown) or the like for supporting a mattress (not shown) positioned on the deck, alternatively the mattress may be positioned directly on top of the panels 12-18.

In FIGS. 1 to 5 the bed 10 is shown in a fully articulated configuration, adjusted for supporting an occupant of the bed in a recumbent zero gravity position. In this position the back support section panel 12 is raised about, and inclined with respect to, the frame 20 about a pivot axis defined by hinges 22 which pivotally connect the upper body support panel 12 and the intermediate section support panel 16 together along their respective adjacent edges. The intermediate support section panel 16 is inclined with respect to the frame about the pivot axis defined by hinges 22. The lower leg section panel 18 is maintained in a horizontal orientation through a third pivot axis defined by hinges 26 which pivotally connect the lower leg support panel 18 to the other end of the intermediate section support panel 16. Hinges 22 and 26 are constructed in preferred embodiments of a fatigue resistant plastics material and may be constructed as a so called "living hinge". Other types of hinge are also contemplated including extruded metal tubes, for example extruded aluminum or aluminum alloy, having a d or p shape cross section, including a longitudinal mounting flange as an integral part of the extrusion. A hinge pin passes through the extruded tube in a known manner and may be mounted on bearings (ball bearing type) located at the respective ends of the tube to support the hinge pin in a low friction manner.

In the lowered position the adjustable support panels 12 16 and 18 combine to define a substantially flat planar horizontal support platform. The various support panels 12, 16 and 18 may each have a mattress support cushion (not shown) of pre-determined thickness, which combine to provide a mattress foundation for supporting a suitable mattress. The panels 12-18 may be upholstered, with or without support cushions. The bed may be a so called "soft edge" adjustable bed having an upholstered bolster around the edges of the bed. The present invention also contemplates arrangements where the frame 10 is integrated in a divan type bed foundation structure. In the illustrated embodiment the bed frame 20 is provided with floor standing legs 28 and is thus self-supporting and may therefore be located in the interior region of a bed surround. The dimensions of the bed are such that the bed has the size of a double bed, but the present invention contemplates beds of many different widths including standard single size beds to much larger doubles. For example, where independent control of each side of a double bed is required, a pair of single size adjustable beds according to the present invention may be arranged in side by side relation so that each occupant may independently control the degree of adjustment on their respective side of the bed.

The frame 20 comprises a generally rectangular structural support, when viewed in plan, and is preferably constructed of metal but other materials may be used for various component parts, in addition to or instead of metal, including board type material, for example engineering plastic, MDF, timber or other fiber type board for example.

The frame 20 comprises a pair of elongate parallel lateral side frame members 30 in the form of side rails. The side frame members have the shape of an inflexion curve with the inflexion point substantially midway along their length. The upper surface of the side frame members has a convex profile along the first half of its length, from the toe end to the inflexion point of the bed, and a concave profile from the inflexion point to the head end of the bed. Thus, the inflexion curves provides for a change in vertical height of the frame along the length of the bed, with the toe end of the side frame members occupying a higher position above the floor on which the bed stands than the head end. The significance of the inflexion curve profile of the side members will become apparent from the description that follows.

The side frame members extend longitudinally along the length of the bed, on opposite sides thereof, and are joined together at their respective ends by metal, preferably steel, cross-members 31, 32 to form a rectangular box type structural support frame. A further cross-member 34 is positioned between the side frame members 30 towards the toe end of the bed. The side frame members 30 are constructed of suitably dimensioned oval shape cross-section metal tube, preferably extruded steel tube, and the cross-member 34 of similar section metal tube. The frame 20 is provided with legs 28 at each of the corners of the rectangular frame structure. The side members 30 and cross-members 31, 32 and 34 are joined together by welding or alternatively by fixing means such as screws, bolts, fasteners or the like. In preferred embodiments the legs are attachably/detachably fixed to the frame by suitable reversible fixing means as well known in the art.

The support frame 20 thereby constitutes the floor standing part of the bed 10 and in this respect the frame may stand directly on legs 28 or be provided with castors, feet or the like at the end of the legs, as is also well known in the art.

Two pairs of guide channels 36 and 38 are provided on the inward facing surfaces of the respective side frame members 30 at longitudinally spaced locations on each side of the bed. The first pair of guide channels 36 is positioned adjacent to the cross member 34 and the second pair 38 in the region of the inflexion point substantially mid-way along the length of the bed. The first guide channel comprises a slightly curved forward section 36*a* and linear rearward section 36*b*. The forward section 36*a* curves upwards slightly from the linear rearward section which extends substantially horizontally in the normal orientation of the bed. A mounting bracket 37 is attached to each of the guides 36 for attachment to the inward facing surface of the respective side member 30, preferably by welding. The second guide channel also comprises a curved forward section 38*a* and linear rearward section 38*b*. The forward section 36*a* is curved upwards from the adjacent linear rearward section 38*b* of the guide which is inclined in an upwards and forwards direction towards the toe end of the bed. A mounting bracket 39 is attached to each of the guides 38 for attachment to the inward facing surface of the respective side member 30, preferably by welding. The curvature of the forward guide section 38*a* is significantly greater than the curvature of the forward guide section 36*b* for reasons as will become apparent from the description that follows.

The guide channels 36 and 38 are U-section open channels with their respective open sides facing inwards into the interior region of the frame 20.

The guide channels 36 and 38 define cam means for guiding the intermediate section 16 of the bed. The guide channels 36 and 38 accommodate respective rollers in the form of bearings 40, 42 mounted on respective bearing pins 40*a*, 42*a* on L-shape 5 brackets 40*b*, 42*b* secured to the underside of the intermediate support section panel 16. Bearings 40 are located at the forward end of the panel 16 adjacent hinges 26. Bearings 42 are located at the midpoint of panel 16 substantially equidistant from the rearward and forward ends thereof. The bearings 40 and 42 define respective cam followers of the guide channels 36 and 38.

A pair of rollers in the form of bearings 44 is provided at longitudinally spaced apart locations at the forward or toe end of the bed. The bearings 44 are mounted on respective mounting pins 44*a* attached to the side frame members 30 on each side of the bed. A first of the bearings 44 is located rearwards of the cross-member 31 and a second is located forwards of the cross-member 34. The bearings are located on the inward facing side of the respective side members and are arranged to support the underside of the support panel 18. As will be described in more detail below the underside of the panel 18 is in rolling contact with the support bearings 44 throughout its range of movement with respect to the frame.

The head end support panel 12 is similarly supported on its underside by rollers in the form of bearings 46 disposed on opposite sides of the frame 20 at the head end of the bed. The bearings are mounted on respective upstanding mounting brackets 48 secured to the side members 30 adjacent to and forward of cross-member 32 at the 25 head end of the bed.

The guides 36 and 38 and their respective bearings 40 and 42 and the bearings 44 and 46 are disposed such that the respective support panels lie flat and level when the bed is lowered, as shown in FIGS. 7 to 9, in the normal orientation of the bed. The bearing brackets 48 extend upwards therefore above the side members 30 to compensate for the degree of inflexion in the side members which lowers the head end of the frame with respect to the toe end.

An electrical linear actuator 52 for moving the support panels 12, 16 and 18 relative to the frame 20 is provided on the underside of the frame between the respective side rails 30. The actuator is of the Delta-drive type produced by Dewert-Okin GmbH and comprises a reversible motor part 54, a gearbox 56, an outer tube 58 and a retractable and extendable rod 60. The actuator 52 is pivotally mounted at the gearbox end of the actuator to the cross-member 34 via a cross-member clevis bracket 62 and pivot pin 64. At the other end the rod 60 is pivotally mounted to a U-shape clevis bracket 66 by means of a clevis pin 68. The bracket 66 is secured to the underside of the intermediate panel 16 in the region of the hinges 22.

The actuator 52 extends generally parallel to the side members 30 and is disposed substantially horizontal in the normal operational orientation of the bed.

Coordinated movement of the panels 12, 16 and 18 relative to the frame 20 is effected by activation of linear electrical actuator 52 positioned on the underside of the bed within the space envelope of the frame. Panel 12 is raised and lowered by respective extension and retraction of actuator 52 acting on panel 16, the movement of which is determined by the geometry of the guides 36, 38. As the actuator 52 is extended the panel 16 moves rearwards towards the head end of the bed as the rollers 40, 42 follow the cam profile of the respective guides 36, 38. As the panel 16 moves rearward the panel also moves downwards. This downwards movement of the panel 16 is greatest at the rearward end of the panel, at hinges 22 due to the difference in guide path geometry between the forward guides 36 and rearward guides 38. The forward end of the panel 16 at hinges 26 does not move downwards as the panel moves rearwards. The initial downward movement of the panel 16 is exaggerated by the downward curved nature of the guide sections 36*a* and 38*a*. This causes the rearward end of the panel to dip below the plane occupied by the upper point on the bearings 46, which generates a turning moment on the rear panel 12 due to the reaction force at the rollers 46 acting on the panel 12 causing it to pivot upwards with respect to the mid panel 16 as panel 16 is moved rearwards. The initial angular adjustment of the rear panel 12 is greater during this initial phase of adjustment as the rollers 40, 42 move from the forward end of the respective guides 36, 38 through the curved sections 36*a*, 38*a*.

The downwards progression of the panel 16 becomes more linear as the actuator is further extended and the rollers 40, 42 move along the linear sections 36*b*, 38*b* of the respective guides 36, 38. As the actuator is extended the rearwards and downwards trajectory of panel 16 causes the rear panel 12 to rise progressively from the non-adjusted position of FIGS. 7-9 to the fully raised inclined position of FIGS. 1-5. The movement of panel 12 follows a zero wall clearance path throughout its range of movement, that is to say a constant gap is maintained between the rearward edge of the panel 12 and surrounding structure, for example a headboard of the bed or adjacent wall, when the panel 12 moves rearwards or forwards with respect to the frame during adjustment of the bed. This functionality provides a wall proximity adjustable bed as the position of the occupant is maintained in proximity with the wall against which the head end of the bed is arranged. As is well known in the art this desirable function also ensures that the occupant is comfortably positioned adjacent bedside furniture and the like when the bed is raised or lowered, maintaining the position of the occupant with respect to their surroundings even when the bed is adjusted to raise the occupant towards a recumbent position.

The initial curved part of the guides 36*a*, 36*b* provides the bed with a greater degree of zero wall clearance functionality during the initial movement when the intermediate panel 16 is moved rearwards and the rear panel 12 begins to rise.

During the rearward movement of the panel 16 by the actuator 52, the forward panel 18 also moves rearward with respect to the frame 20. Relative pivoting of the panels 16 and 18 at hinges 26 ensures that the forward panel 18 remains horizontal. Contact between the underside of the panel and rollers 44 is maintained under gravity by the weight of the panel and that part of any mattress positioned on the bed that is carried by the panel 18.

The bed of FIGS. 1-9 comprises so called "zero-gravity" functionality, that is to say it is capable of supporting the occupant in a zero gravity recumbent position when the rear panel is raised to an inclined position. Coordinated movement of the panels 12, 16 and 18 during extension and retraction of the actuator is such that the rear end of the mid-section panel at hinge 22 occupies a lower position relative to the forward end of the panel at hinge 24 in all adjustment positions of the bed. Panel 16 is therefore inclined downwards in the rearwards direction of the bed in all adjustment positions when the rear panel 12 is raised or inclined upwards. In this respect the occupant is less likely to experience discomfort due to the raised rear panel creating a forward force on the occupant's body forcing the occupant towards the toe end of the bed. The dipping nature of the rear hinge line 22 compensates for such effects due to its proximity to the occupant's hip joint and the raised position of the hinge line 26 is in proximity to the occupant's knee joint.

Referring now to FIGS. 10 to 14 which show a second embodiment of a wall proximity adjustable bed according to the present invention. In the drawings of FIGS. 10 to 14 the same reference numerals are used to designate the same or similar components as in the embodiment of FIGS. 1 to 9. The adjustable bed of FIGS. 10 to 11 differs from the bed of FIGS. 1 to 9 in a number of respects. In the second embodiment the elongate parallel lateral side frame members 30' are straight, not curved. The side frame members are constructed as box section rails having a flat upper surface.

Instead of the rollers 44, a pair of rollers in the form of bearings 44' is provided at the forward or toe end of the bed. The bearings 44' are mounted on respective mounting brackets 70 attached to the underside of the panel 18 on both sides of the bed. The brackets 70 are positioned approximately half way along the length of the panel 18. The bearings 44' are arranged to run on the upper surface of the side frame members 30' as the adjustable panels are moved with respect to the frame.

Pairs of guide channels 36' and 38' are provided on the inward facing sides of the respective side frame members 30' at longitudinally spaced locations on each side of the bed. The guide channels 36' and 38' are attached to planar mounting plates 72 attached to the inward facing surfaces of the respective side frame members 30' rearward of the forward cross-member 34'.

The first pair of guide channels 36' is positioned adjacent to the cross member 34' at the forward end of the mounting plates 72 and the second pair 38' rearwards thereof. In this embodiment the first guide channel is straight and provides a linear guide along its length and extends substantially horizontally in the normal orientation of the bed. The second guide channel 38' comprises a linear forward section 38*a*', a curved mid-section 38*b*' and linear rearward section 38*c*'. The mid-section 38*b*' is curved upwards from the adjacent linear rearward section 38*c*' of the guide which is inclined in an upwards and forwards direction towards the toe end of the bed. The length of the forward guide section 38*a*' is significantly less than the length of the mid and rearward sections of the guide 38' for reasons as will become apparent from the description that follows.

The guide channels 36' and 38' are U-section open channels with their respective open sides facing inwards into the interior region of the frame 20.

As in the previous embodiment, the guide channels 36' and 38' define cam means for guiding the intermediate section 16 of the bed. The guide channels 36' and 38' accommodate the respective rollers 40, 42 mounted on the underside of the intermediate support section panel 16.

A pair of ramp elements 74 is provided at the rearward end of the frame 20 on the side members 30'. The ramp elements are provided on both sides of the frame and provide an inclined upper surface 76 which are adapted to support respective rollers in the form of bearings 78 mounted on respective downward depending brackets 80 attached to the underside of the rear panel 12. The upper surfaces of the ramp elements are inclined towards the rear or head end of the bed.

As in the previous embodiment, actuator 52 is pivotally mounted at the gearbox end of the actuator to the cross-member 34' via a cross-member clevis bracket 62 and pivot pin 64. At the other end, however, the rod 60 is pivotally mounted to the apex of a V-shape forked bracket 82 by mean of a pin 68'. The distal ends of the respective forks are attached to the underside of the panel 12 in the region of the hinged end of the panel. A reinforcement bracket 84 extends between the apex of the forked bracket 82 and the underside of the panel 12 at a position approximately midway along its length.

The operation of the bed of the second embodiment is similar to the operation of the bed of the first embodiment. Coordinated movement of the panels 12, 16 and 18 relative to the frame 20 is effected by activation of linear electrical actuator 52. Panel 12 is raised and lowered by respective extension and retraction of actuator 52 acting on panel 12, the movement of which is determined by the geometry of the guides 36', 38', the ramp elements 74 and respective rollers 78. As the actuator 52 is extended the panel 16 moves rearwards, linearly at first, towards the head end of the bed as the rollers 40, 42 follow the cam profile of the respective guides 36', 38'. As the panel 16 moves rearward the panel also moves downwards after an initial horizontal only movement, as determined by the linear section 38*a*' of the guide 38'. The subsequent downward movement of the panel 16 is greatest at the rearward end of the panel, at hinges 22 due to the difference in guide path geometry between the forward guides 36' and rearward guides 38'.

As the panels 12, 16 and 18 move rearwards the rollers 78 follow the inclined surface of the ramp elements so that the rear or head end panel 12 is progressively raised. The ramp elements 74 and rollers 78 ensure that the distance between the hinge 22 and the contact point between the rollers 78 and the ramp elements remains the same as the panel rotates. The panel 12 is thus supported at the same point along its length throughout its range of movement.

During the rearward movement of the panel 16 by the actuator 52, the forward panel 18 also moves rearward with respect to the frame 20. Relative pivoting of the panels 16 and 18 at hinges 26 ensures that the forward panel 18 remains horizontal. Contact between the underside of the panel and rollers 44' is maintained under gravity by the weight of the panel and that part of any mattress positioned on the bed that is carried by the panel 18.

The ramp elements 74 are each provided with rollers in the form of bearings 86 at their respective distal ends. The rollers 86 contact the underside of the panel 12 when the panel 12 lies flat above the frame 20, that is to say, in the flat configuration of the bed.

In a further embodiment (not shown), the toe end section comprising the lower leg and foot support panel 18 is divided, that is to say the panel 18 is divided to provide both a lower leg support part and an adjustable foot support part hinged with respect to the lower leg support part and having angular adjustment means for adjusting the angle between both parts, as is known in the art.

Having described at least one of the preferred embodiments of the present invention with reference to the accompanying drawings, it will be apparent to those skills that the invention is not limited to those precise embodiments, and that various modifications and variations can be made in the presently disclosed system without departing from the scope or spirit of the invention. Thus, it is intended that the present disclosure cover modifications and variations of this disclosure provided they come within the scope of the appended claims and their equivalents.

The invention claimed is:

1. A wall proximity adjustable bed having zero wall clearance and zero gravity functionality, said bed comprising:

a frame and an adjustable mattress support platform having a plurality of articulated support sections pivotally mounted with respect to one another for relative angular adjustment;

said frame having a first and a second lateral side;

an actuator effecting co-ordinated movement of said support sections to reconfigure the bed between a flat lowered configuration and a raised configuration thereby supporting an occupant in a zero gravity recumbent position;

said plurality of articulated mattress support sections include at least a head end section, a toe end section and an intermediate section disposed between the head and toe end sections;

a cam associated with one of the frame and the intermediate support section and a cam follower associated with the other of the frame and the intermediate movable support section;

said cam comprises a first and a second guide;

said first and second guides each further comprise a first and a second guide section;

said first and second guide sections each further comprise at least one curved guide section;

said first guide section further comprises said curved guide section; and wherein said first curved guide section has a cam profile that is configured so that an initial movement of said intermediate section by said actuator in a rearwards direction has a greater downward vertical component of movement than in said second guide section.

2. A wall proximity adjustable bed, having zero wall clearance and zero gravity functionality, said bed comprising:

a frame and an adjustable mattress support platform having a plurality of articulated support sections pivotally mounted with respect to one another for relative angular adjustment;

said frame having a first and a second lateral side; and an actuator effecting co-ordinated movement of said support sections to reconfigure the bed between a flat lowered configuration and a raised configuration thereby supporting an occupant in a zero gravity recumbent position;

wherein said plurality of articulated mattress support sections include at least a head end section, and wherein the head end section includes one of a ramp or roller, and the frame includes the other of the ramp or roller, in which the head end section is supported by one of the ramp or roller when the head end section is raised by the extension of the actuator means.

3. A wall proximity adjustable bed, as claimed in claim 2, wherein:

the head end section includes the roller, and the frame includes the ramp, in which the head end section is supported by the ramp when the head end section is raised by the extension of the actuator means.

4. A wall proximity adjustable bed, as claimed in claim 2, wherein:

the ramp is a pair of ramp elements.

5. A wall proximity adjustable bed, as claimed in claim 2, wherein:

the ramp is provided at a rearward end of the frame.

6. A wall proximity adjustable bed, as claimed in claim 2, wherein:

the ramp comprises an inclined upper surface.

7. A wall proximity adjustable bed, as claimed in claim 2, wherein:

the rollers are mounted on respective downward depending brackets attached to the underside of the head end section.

8. A wall proximity adjustable bed, having zero wall clearance and zero gravity functionality, said bed comprising:

a frame and an adjustable mattress support platform having a plurality of articulated support sections pivotally mounted with respect to one another for relative angular adjustment;

said frame having a first and a second lateral side;

an actuator effecting co-ordinated movement of said support sections to reconfigure the bed between a flat lowered configuration and a raised configuration thereby supporting an occupant in a zero gravity recumbent position;

said plurality of articulated mattress support sections include at least a head end section, a toe end section and an intermediate section disposed between the head and toe end sections;

at least one first cam associated with one of the frame and the intermediate support section and at least one first cam follower associated with the other of the frame and the intermediate support section; and and at least one second cam associated with one of the frame and the foot support section and at least one second cam follower associated with the other of the frame and the foot support section;

wherein said first and second cams are configured so that the cam of the first and second cams closest to the head support section provides a greater downward vertical component of movement than in said other cam of the first and second cams.

* * * * *